US006123139A

United States Patent [19]

Kalempa et al.

[11] Patent Number: 6,123,139

[45] Date of Patent: Sep. 26, 2000

[54] OVERHEAD RIGID-PANEL DOOR

[75] Inventors: Walenty Kalempa, Slinger; Joe M. Delgado, West Bend, both of Wis.

[73] Assignee: Rytec Corporation, Jackson, Wis.

[21] Appl. No.: 09/142,995

[22] PCT Filed: Jul. 24, 1998

[86] PCT No.: PCT/US98/15414

§ 371 Date: Sep. 14, 1998

§ 102(e) Date: Sep. 14, 1998

[87] PCT Pub. No.: WO99/05384

PCT Pub. Date: Feb. 4, 1999

Related U.S. Application Data

[60] Provisional application No. 60/053,820, Jul. 25, 1997.

[51] Int. Cl.[7] ..... E05F 15/08

[52] U.S. Cl. ..... 160/188; 160/133; 160/201

[58] Field of Search ..... 160/133, 201, 160/229.1, 188

[56] References Cited

U.S. PATENT DOCUMENTS

| | | | |
|---|---|---|---|
| 2,325,992 | 8/1943 | Wirthman . | |
| 4,120,340 | 10/1978 | Stascavage et al. | 160/133 |
| 4,126,173 | 11/1978 | Theuerkauff | 160/229.1 |
| 4,655,019 | 4/1987 | Rejc . | |

(List continued on next page.)

FOREIGN PATENT DOCUMENTS

| | | | |
|---|---|---|---|
| 0 057 293 A1 | 8/1982 | European Pat. Off. . | |
| 0 501 939 A1 | 9/1992 | European Pat. Off. . | |
| 0 624 705 A1 | 11/1994 | European Pat. Off. . | |
| 0 737 796 A2 | 10/1996 | European Pat. Off. . | |
| 1076329 | 10/1954 | France | 160/133 |
| 2 380 400 | 9/1978 | France . | |
| 2 588 038 | 4/1987 | France . | |
| 44 11 997 C1 | 6/1995 | Germany . | |
| 296 15 102 U1 | 1/1997 | Germany . | |
| 535547 | 11/1955 | Italy | 160/133 |
| 6701920 | 8/1967 | Netherlands | 160/133 |
| 425012 | 3/1935 | United Kingdom | 160/133 |

*Primary Examiner*—Blair M. Johnson
*Attorney, Agent, or Firm*—Wallenstein & Wagner, Ltd.

[57] ABSTRACT

A rigid-panel overhead door which is selectively moved up and down to open and close an opening and which is guided generally along door guides on opposed vertical sides of the opening is disclosed. The door includes a first chain disposed along one of the door guides and a second chain disposed along an opposed door guide. The door further includes a plurality of panels, each having a first end and a second end, the panels being of sufficient length to extend substantially across the opening but sufficiently limited in length so as to fit between the first and second chains and not extend beyond them. The door further includes a plurality of connectors for joining the first and second chains respectively to the first and second ends of each of the panels. Also disclosed is a rigid-panel overhead door including a door guide having a first portion which guides the door body vertically, a second portion which guides the door body horizontally, and a third portion which directs the door body into a coiled position for storage when the door is in an overhead position. The door also has a motor operatively connected to the door to move the door body along the door guide to open and close the door. The motor is situated so that a space between the first and third door guide portion is provided. The space is of sufficient size to accommodate locating at least the motor so that the door body does not obstruct access to the motor from at least one direction when the door body is accumulated into an overhead position. A method of making a hinge for use in an interlinked hinge chain for guiding and moving a door between an open and a closed position is also disclosed. The method comprising the steps of (1) defining a desired hinge thickness, height and profile as viewed from a cross section through a thickness of the hinge; (2) providing an extrusion mold which will extrude elongated stock having the desired thickness, height and profile; and (3)cutting or otherwise dividing the extruded length into the desired width for the hinge.

33 Claims, 4 Drawing Sheets

U.S. PATENT DOCUMENTS

| | | | |
|---|---|---|---|
| 4,754,795 | 7/1988 | Garrod | 160/133 |
| 4,947,937 | 8/1990 | Searer et al. | 160/133 |
| 4,986,331 | 1/1991 | Henkenjohann | 160/201 |
| 5,299,617 | 4/1994 | Hying et al. . | |
| 5,394,924 | 3/1995 | Rejc . | |
| 5,477,902 | 12/1995 | Kreautler | 160/264 |
| 5,484,007 | 1/1996 | Rejc . | |
| 5,887,636 | 3/1999 | Neukam | 160/133 |

OVERHEAD RIGID-PANEL DOOR

This application claims benefit of Provisional Appl. 60/053,820, filed Jul. 25, 1997.

DESCRIPTION

1. Technical Field

The invention relates to industrial doors, in particular segmented rigid-panel doors which are accumulated overhead when in the open position.

2. Background of the Invention

Overhead doors have been used for many years to secure various enclosures including manufacturing plants, warehouses, garages, and other industrial doorways that require a heavy duty cycle. Such doors are generally comprised of articulated, joined panels or slats. Generally, such overhead doors are guided by tracks along door jambs, facilitating movement of the door between open and closed positions. The guide tracks used with slat-type or segmented panels generally extend upwardly above the door opening for storing the door when in an opened position. In places where overhead space is insufficient, the track may guide the door at a backward angle above the door opening.

Recently, however, it has been proposed to accumulate the door panels above the door by guiding the panels into an overlapping, coiled or spiraled configuration. Such overhead doors have been guided for movement up and down by guide tracks consisting of essentially three basic portions. Examples of such overhead doors are disclosed in U.S. Pat. Nos. 5,484,007 and 5,394,924. The first portion of the guide tracks extend vertically along the sides of the door or jambs. The second portion of the guide tracks extends above the opening, turns horizontally at the top of the doorway, and extends away from the wall. The third portion of the guide tracks forms an inward coiled configuration which encircles a door drive motor. Accordingly, as the door is lifted, it is guided along the guide tracks and directed into the coiled configuration. While these overhead doors have enjoyed a great deal of success, they have also presented various problems as will be discussed herein.

In particular, problems exist in the ability of the door to withstand impact without sustaining debilitating damage to the door and its associated guide structure. Because overhead doors are generally used to secure industrial areas with high traffic, the door is often not completely open before attempted transit through the doorway by vehicles such as forklift trucks. Accordingly, at least the bottom-most panels are subjected to impact by these vehicles. Therefore, at least one or more of the bottom-most panels of the door must be able to withstand frontal impact without sustaining severe damage to the entire door or its associated jambs. Replacement of the overhead door or panels can be costly and can also result in increased down-time.

Additionally, doors, such as those disclosed in U.S. Pat. Nos. 5,484,007 and 5,394,924, employ a chain of interconnecting hinges to lift the door between opened and closed positions. The hinges are strap-like and are mounted to only one face of a respective panel. Problems exist with respect to the ability of hinge straps to adequately distribute forces which are created during movement of the door. The straps overlap an end portion of the slats and are bolted thereto. The hinge straps typically consist of thin formable metal. Each hinge has a male end and a female end created by rolling the ends of the metal into loops. The mated loops are rotatably secured by hinge pins. In overhead doors using such hinges, the distribution of force created by movement of the door can cause the hinges to wear prematurely or be damaged. In particular, the stresses applied to the interconnected loops, created by repeated opening and closing of the door can cause the ends to become "unrolled." Additionally, the male and female portions cannot generally be centered to the middle of a door panel as centering the portions requires that the metal be extended at an angle inwardly from a face of the panel, where the main body of the strap-type hinge is secured. Bending the metal may result in increased stresses at the angle of the metal. Thus, there is a need for a stronger panel-hinge assembly that can accommodate doors having a large duty cycle.

Another problem with previous overhead doors is the configuration of the overhead guide track. Typically, when the overhead door is being serviced for maintenance, it is desirable to keep the door in an overhead position to allow continued use of the doorway or opening. However, in previous overhead guide configurations, the motor and much of the associated drive apparatus are surrounded by the door panels when the door is in its overhead position. Such configurations make access to the motor and associated drive difficult. These configurations also require that the door be at least partially disassembled if repair or replacement of the motor or its parts is necessary. Disassembly of the door can ultimately result in non-use and increased down-time of the door. Consequently, there is a need for an overhead accumulation configuration that does not impede access to the motor assembly and associated apparatus.

The present invention is provided to solve these and other problems and provide advantages and aspects not provided by prior doors of this type.

SUMMARY OF THE INVENTION

The present invention provides an overhead rigid-panel door which is selectively movable up and down to open and close an opening and is accumulated overhead in a coiled-type configuration.

According to one aspect of the present invention, a door is provided which has a pair of chains for movement of a plurality of rigid panels up and down. The chains are disposed between the panels and door guides at opposed sides of the door. Each chain comprises a plurality of interconnecting hinges. The panels each have a first end and a second end and are of sufficient length to extend substantially across the opening, but sufficiently limited in length to fit between the first and second chains and not extend beyond them. The door also includes a means for connecting each door panel to a separate pair of hinges at the first and second ends of each panel.

According to another aspect of the present invention, a door is provided which includes a door body having a plurality of panels hingedly connected together. The door includes a door guide having a first portion which guides the door panels vertically, a second portion which guides the door panels at an angle to the vertical, and a third portion which directs the door body into an overlapped or coiled configuration for storage when the door is in an open position. The door in the present invention further includes a motor which moves the door body along the door guide thereby opening and closing the door. The door panels in an accumulated position are situated so that a space exists between the first panels and the first door guide portions. The present invention requires that the space be of sufficient size to accommodate locating at least the motor therein so the door does not obstruct access to the motor from at least one direction when the door body is accumulated overhead into the coiled configuration.

According to yet another aspect of the present invention, a method of making a hinge is provided. The method includes defining a desired hinge thickness, height and profile as viewed from a cross section through the thickness. The method also requires using an extrusion mold, which will extrude elongated stock, having the desired thickness, height and profile as viewed through the cross-section or the thickness. The method further requires cutting or otherwise dividing the extruded length into the desired width. Finally, the method requires removing unwanted material at one end of the height of the hinge to define a male mating portion and two spaced extending portions at the other end of the hinge to define a female mating portion.

Other advantages and aspects of the present invention will become apparent upon reading the following description of the drawings and detailed description of the invention.

DETAILED DESCRIPTION

Figure 1:
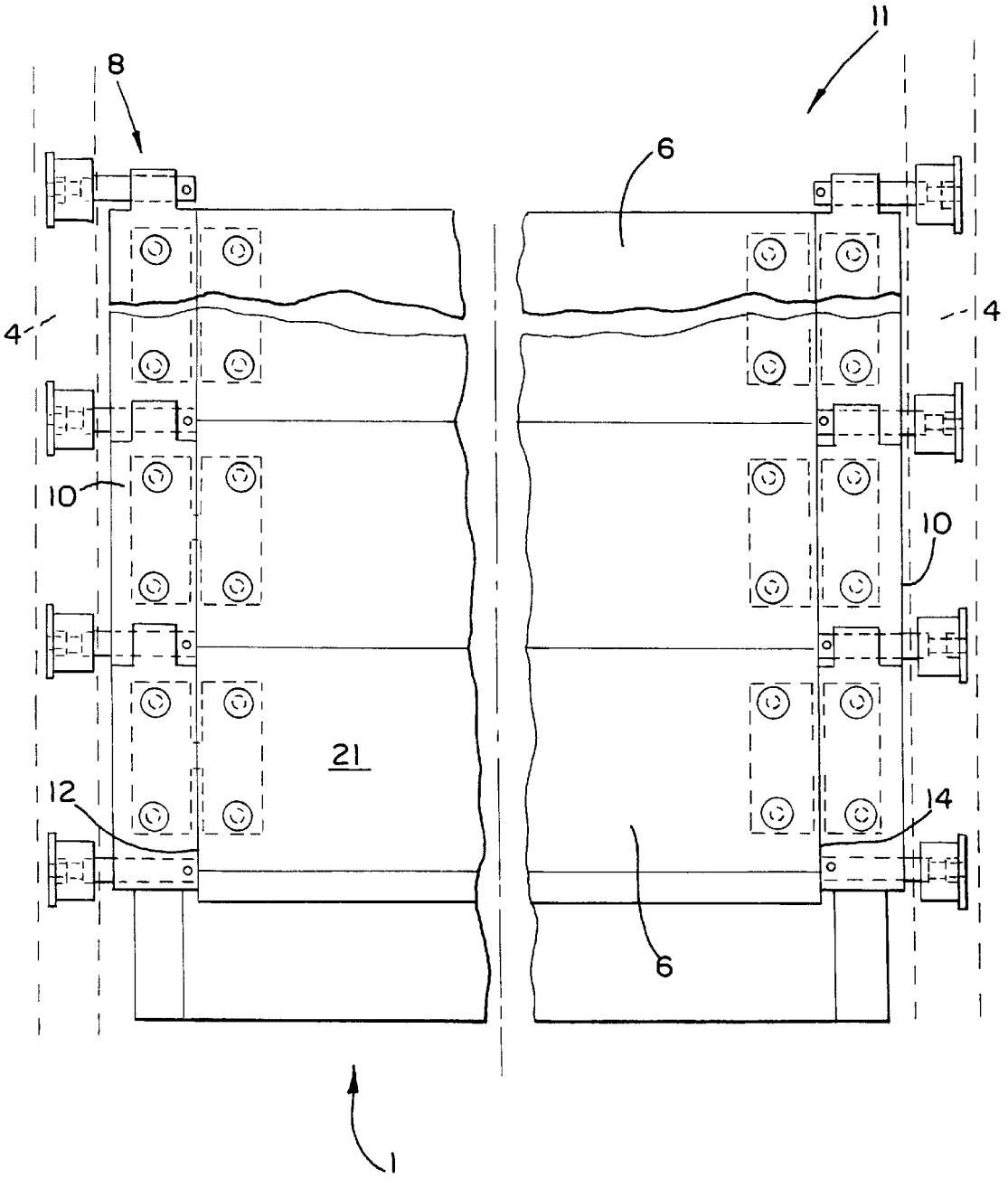
FIG. 1 is a front view of a preferred door embodiment according to the invention, showing a door guide in phantom.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspects of the invention to the embodiments illustrated.

Figure 2:
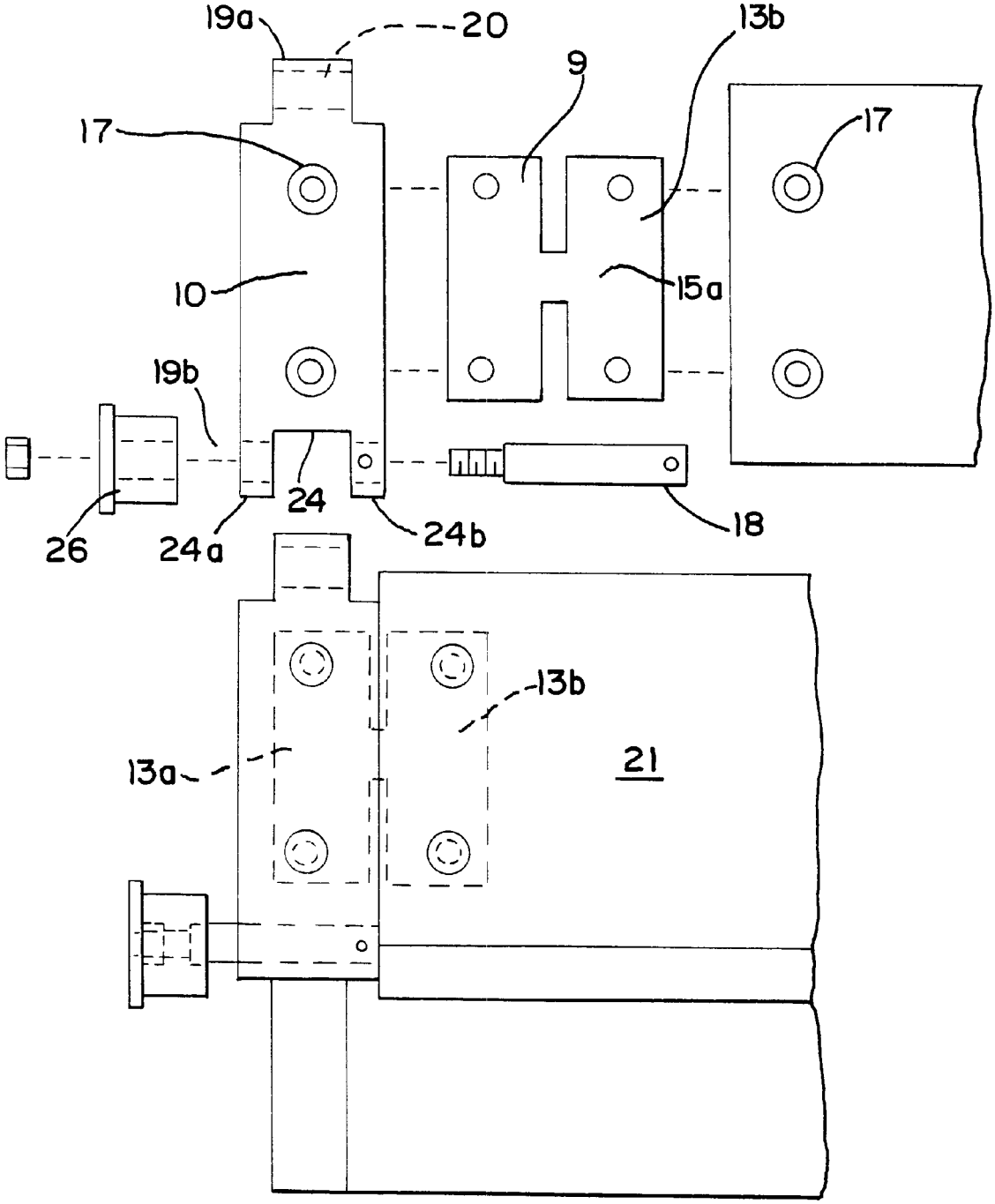
FIG. 2 is an exploded front view of a hinge and door panel assembly (in partial) in connection with a second assembled hinged body and door panel assembly (in partial) of a preferred door embodiment of FIG. 1.
Figure 3:
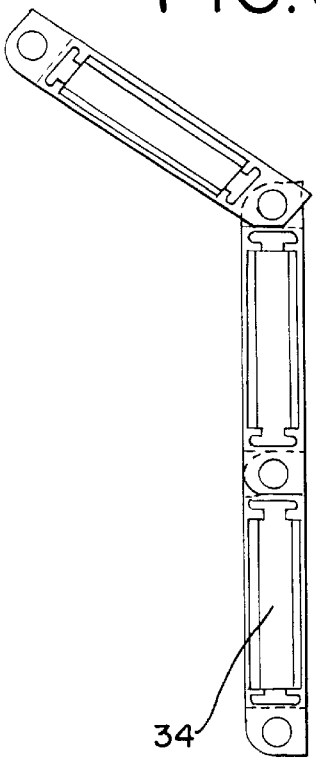
FIG. 3 is a side view of interconnected hinges according to the present invention.
Figure 4:
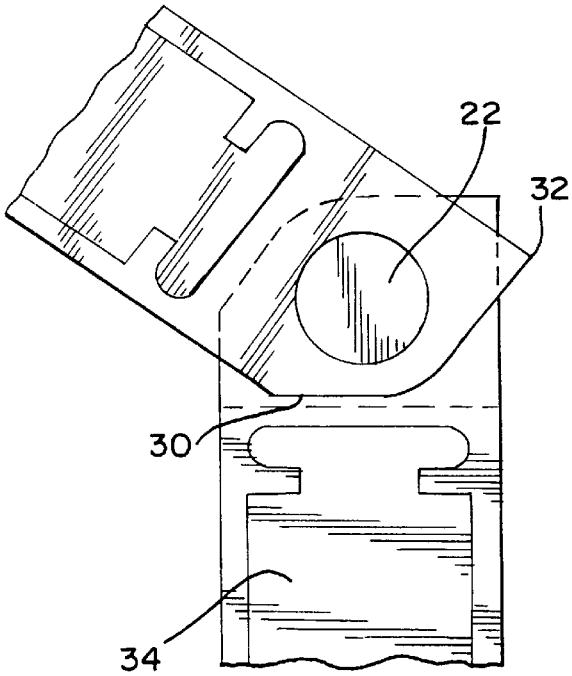
FIG. 4 is an enlarged partial view of the interconnected hinges of FIG. 3.

FIGS. 1–9 disclose an improvement on previous overhead rigid-panel door and hinge assemblies. According to one aspect of the present invention, a door 1 which is selectively moved up and down to open and close an opening (not shown) and which is guided along side guide tracks 4 at the edge of the opening is disclosed. As shown in FIGS. 1 and 2, the overhead door 1 generally includes a plurality of panels 6, a pair of chains 8 defined by interlinked hinges 10, and a means for connecting each panel 6 to a separate pair of hinges 10.

FIG. 1 illustrates a plurality of panels 6, each having a first end 12 and a second end 14. Each panel 6 is of sufficient length to extend substantially across the opening, but sufficiently limited in length so as to fit between and not extend across the chains 8 on opposed sides of the opening. Each door panel 6 generally abuts the two respective hinges 10 with which it is associated.

FIGS. 1–4 show the chains 8 which move the panels 6, and therefore the door 1, up and down. The chains 8 are defined by interlinked hinges 10 and are disposed between the panels 6 and the guide tracks 4. Each of the hinges 10 which comprise the chain 8 is pivotal about a hinge pin 18. Each of the hinges 10 has two ends 19*a* and 19*b*. The first end 19*a* of each hinge 10 has an extending male portion 20 with a through-hole 22 for receiving the hinge pin 18. The second end 19*b* has a pair of spaced extending portions 24*a* and 24*b* defining a female portion 24. Each of the extending portion 24*a*, 24*b* of the female portion 24 also has a through-hole 22 for receiving a hinge pin 18. The through-holes 22 of both the male 20 and female 24 hinge portions are aligned so that they are generally centered between a front surface (see FIG. 2) and a back surface (not shown) of the panels 6 for improved force distribution.

FIG. 1 and FIG. 2 illustrate the means for connecting the panel 6 to its respective two hinges 10. The means for connecting at least the bottom-most panel to its respective two hinges 10 includes connecting inserts 9. The connecting inserts 9 permit separation of the panel 6 from the hinges 10 upon an impact to the panel 6 in excess of a predetermined force, as will be explained below.

Figure 8:
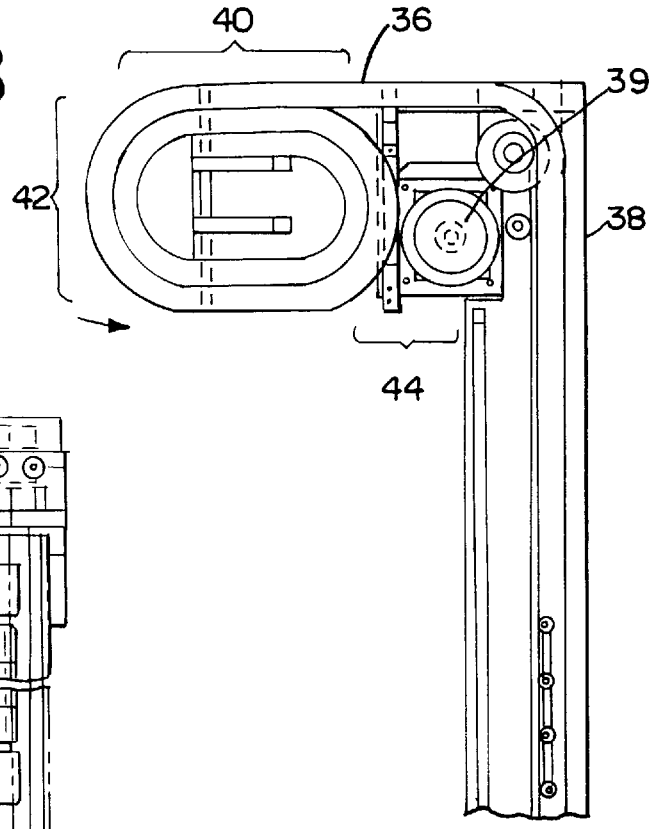
FIG. 8 is a side view of the overhead door of FIG. 1 with motor and coiled door guide.
Figure 9:
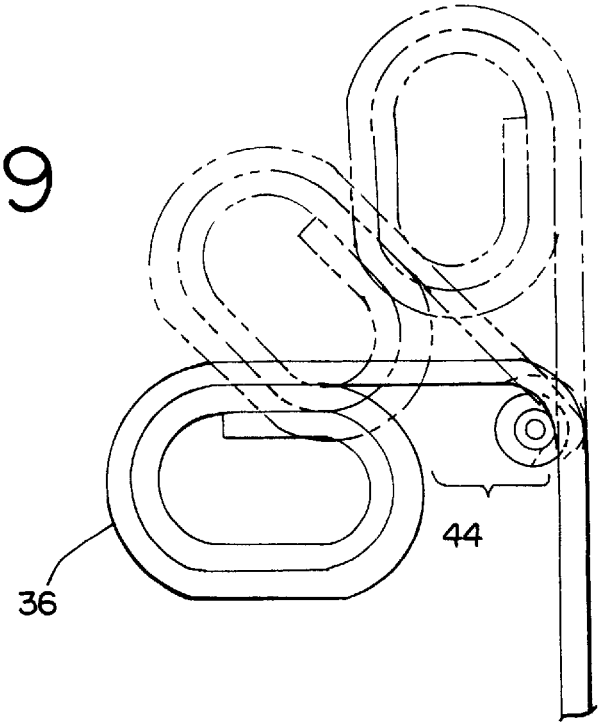
FIG. 9 is a schematic side view of an overhead door according to the invention, illustrating a coiled door guide at varying angles.

As shown in FIG. 1 and FIG. 2, the door guide requires at least some of the hinge pins 18 to extend to the door guides 4. Each of the hinge pins 18 that are extended have a roller 26, rotationally engaged proximate the extended ends of the hinge pins 18. Each roller 26, in turn, engages the door guide 4 (FIGS. 8 and 9).

In the preferred embodiment, the hinges 10 are structurally biased to rotate in only one direction and to resist rotation in the opposite direction. The hinges 10 rotate between a straight in-line position when the door 1 is closed, to an angled position when the door 1 is accumulated overhead. As may be seen in FIGS. 3 and 4, the structural bias is provided by terminating the male 20 and female 24 extending portions with a rounded shoulder 30 toward a side to which rotation is desired, and providing a squared shoulder 32 toward the opposite side where rotation is not desired.

In the preferred embodiment, the door panels 6 include receptacles 33 (now shown) formed in each of the first and second ends, 12 14 of each panel 6, and each hinge 10 has a receptacle 34 being formed in its body. Also in the preferred embodiment, the connecting inserts 9 have first end 13*a*, a second end 13*b* and a center portion 15. The first end 13*a* of the connecting insert 9 is secured by suitable means in the receptacle 34 of the hinge 10. Likewise, the second end 13*b* is secured by suitable means in the receptacle 34 of one of the ends 12, 14 of the panel 6. The means for securing the insert, may be bolts, pins, or any device suitable for securing two members.

Figure 5:
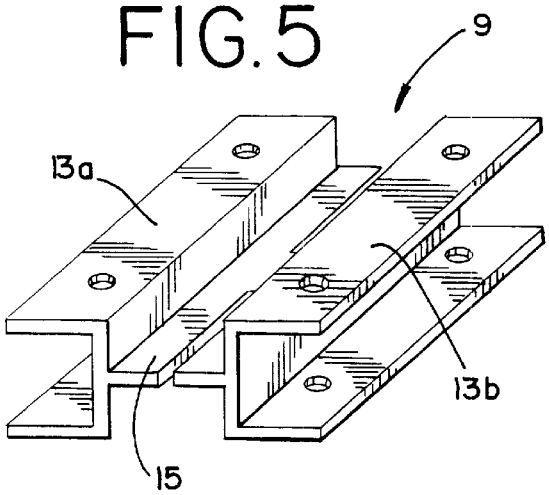
FIG. 5 is a perspective view of a connecting insert according to the present invention.
Figure 6:
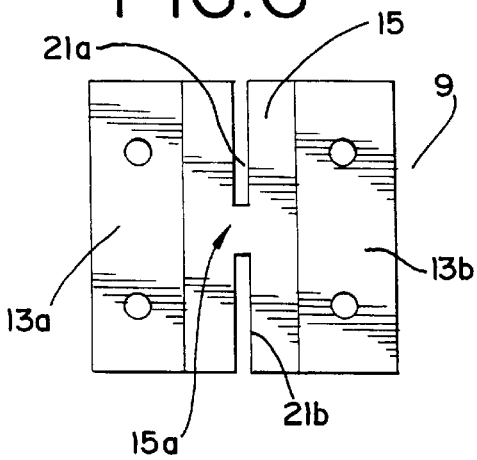
FIG. 6 is a top view of the connecting insert of FIG. 5.

The connecting inserts 9 between at least the bottom-most panel 6 and its two respective hinges 10 is sacrificially broken at the thinned portion 15*a* of the insert 9 when the panel 6 is impacted by a force in excess of a predetermined force. In other words, when the door panel 6 is impacted, the connecting insert 9 will shear or fracture. This permits the panel 6 to separate from the hinge 10, reducing damage to the hinges 10 or the door 1. As shown in FIGS. 5 and 6, a preferred method of weakening this area is simply to cut slots 21*a*, 21*b* into the center portion 15 to a depth which will give the desired predetermined force for separation. It is contemplated that the connecting insert 9 can be configured to cause the door to separate door panel 6 from hinges 10 in other ways. For example, a connecting insert 9 made of a material, such as rubber, may be used so that when impacted, the material flexes to dislodge from either the receptacles 34 or 33.

Figure 7:
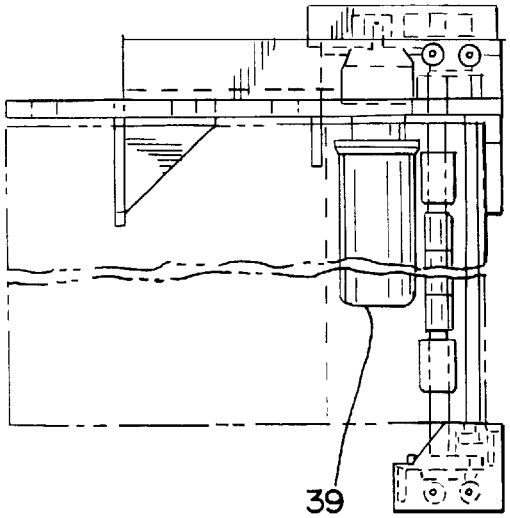
FIG. 7 is a top view of the overhead door of FIG. 1 with motor including the coiled door guide being shown in phantom.

Another aspect of the present invention is shown in FIGS. 7–9 in which the door 1 is guided by door guides 4 and accumulates overhead when in an open position. FIG. 8 shows the door guide 4 having a first portion 38, a second portion 40, and a third portion 42. The first portion 38 of the door guide 4 guides the door 1 vertically while the second portion 40 guides the door horizontally. The third portion 42 directs the door 1 into a coiled configuration for storage when the door 1 is in an open position.

As can further be seen in FIG. 8, a motor 39 is operably connected to the door 1 to move the door 1 along the door guide 4. The accumulated panels 6 are situated so that there exists a space 44 between the first guide portion 38 and the panels 6. The space 44 is of sufficient size to accommodate access to the motor 39 from at least one direction when the door 1 is accumulated into the coiled configuration.

In the preferred embodiment the coiled configuration extends horizontally away from the door opening. However, it is contemplated that the coiled configuration may extend away from the door opening at any angle in which the motor 39 may still be accessed in space 44 when the panels 6 are accumulated into the coiled configuration. It is further contemplated that "coiled" herein merely means that the door guide 36 coils "back on itself" regardless of how many times, and is not meant to be constrained to spirals, circles or any other particular geometric shape.

Conventional hinges are configured to attach to either faces or adjoining edge surfaces of the two entities to be hinged together, for example see U.S. Pat. Nos. 5,484,007 and 5,394,924. However the hinges 10 of the present invention are uniquely configured to be located on the end surfaces of the two panels 6 which are to be hinged together. While the door 1 is shown using inserts 9 for connection, other means for connecting the ends of panels 6 to a hinge according to the invention could be used such as conventional fasteners (bolts, screws, glue) used in connection with flanges, brackets or other well known means to connect the side of the hinge to an end of a panel.

According to another aspect of the invention, the hinges 10 can be advantageously manufactured by defining a desired hinge thickness 46, height 48 and profile as viewed from a cross section through the thickness 46. Secondly, using an extrusion mold which will extrude elongated stock having the desired thickness 46, height 48 and profile as viewed through a cross section of the thickness 46. Thirdly, cutting or otherwise dividing the extruded length into the desired width 50 for the hinge. Finally, removing unwanted material to form an extended portion at one end of the height 48 of the hinge to define a male mating portion 20 and at the other end of the height 48 to define a female mating portion 24. The removal of unwanted material may be done on the bar stock prior to cutting the extrusion into separate hinges 10. One can also provide an extrusion mold with means to extrude the through-holes 22 for hinge pin 18 connection between hinges 10. Alternately the through-holes 22 may be formed by boring or drilling either after defining the extended male 20 and female 24 portions, or before removing the unwanted material to define those portions. Preferably, the mold may also be equipped with means to provide a hollowed center in the profile of the hinge 10 and extrudate as viewed in cross section through the thickness 46. The hinges 10 of the door 1 are preferably made in the above manners from aluminum.

While the specific embodiments have been illustrated and described, numerous modifications come to mind without significantly departing from the spirit of the invention and the scope of protection is only limited by the scope of the accompanying Claims.

What is claimed is:

1. A door which is selectively moved up and down to open and close an opening and which is guided generally along door guides on opposed vertical sides of the opening comprising:

a first chain disposed along one of the door guides and a second chain disposed along an opposed door guide, the first and second chain being defined by a plurality of interlinked hinges having a length, a width and a thickness, wherein the width of each hinge is substantially equal to the width of the other of the hinges;

a plurality of panels, each having a first end and a second end, the panels being of sufficient length to extend substantially across the opening but sufficiently limited in length so as to fit between the first and second chains such that there is no overlap of either the first or second end of the panels with any portion of the first and second chains; and, a plurality of distinct connectors for joining the first and second chains respectively to the first and second ends of each of the panels.

2. The door of claim 1 further including a roller and door guide assembly for guiding the chains, the roller and door guide assembly having hinge pins wherein at least some of the hinge pins extend through a through-hole in the hinges and into the door guide, each extended hinge pin having rollers being rotationally engaged proximate the extended ends of the hinge pins, the rollers engaging a guide track thereby carrying the panels between an open and a closed position.

3. The door of claim 2 further including a motor operatively connected to the door, wherein the door guide includes:

a first portion which guides the door vertically, a second portion which guides the door at any desired angle from 0 to 90 degrees from the vertical, and a third portion which directs the door into a coiled position for storage when the door is in an overhead position;

the first and third portion of the guide track being spaced to permit location of the motor, so that the door does not obstruct access to the motor from at least one direction when the door body is accumulated into the overhead position.

4. The door of claim 1 wherein the first and second chains are defined by a plurality of interlinked hinges, and wherein the hinges are structurally biased to rotate in a first direction from a straight in-line position when the door is closed to an angled position when the door panels are being accumulated overhead, but biased to resist rotation from a straight in-line position in a second direction opposite the first direction.

5. The door of claim 4 wherein the structural bias is provided by terminating a male extending portion and a female extending portion with a rounded shoulder toward a side to which rotation is desired and a squared shoulder toward the opposed side where rotation is not desired.

6. The door of claim 1 wherein the first and second chains are defined by a plurality of interlinked hinges, and wherein the connector joins each of the first and second ends of each panel generally in abutting relationship with a respective hinge in the first and second chain.

7. The door of claim 1 wherein the first and second chains are defined by a plurality of interlinked hinges, and wherein each panel has a thickness equal to a thickness of the corresponding hinge that carries the panel.

8. The door of claim 1 wherein the first and second chains are defined by a plurality of interlinked hinges, and wherein the connector for joining at least the bottom-most panel to its respective two hinges permits separation of the panel from the hinges upon an impact to the panel in excess of a predetermined force.

9. The door of claim 8 wherein the first and second chains are defined by a plurality of interlinked hinges, and further comprising:

a panel receptacle in each end of at least the bottom-most panel;

a hinge receptacle in at least one side of each hinge to which the panel is joined at its ends; and, the connectors for joining at least the bottom-most panel to the chains are connecting inserts and have a first end, a second end and a center portion, the first end being secured in the hinge receptacle and the second end being secured in the panel receptacle.

10. The door of claim 9 wherein, at least one of the connectors for at least the bottom-most panel is sacrificially bent when the panel is impacted with a force in excess of a predetermined force and one of either the first or second ends of the connector withdraws from the panel or the hinge.

11. The door of claim 9 wherein, the connectors for at least the bottom-most panel is sacrificially broken when the panel is impacted with a force in excess of a predetermined force.

12. The door of claim 9 wherein the center portion of the connecting insert between at least the bottom-most panel and its two respective hinges is structurally weaker than the remaining portions of the connecting insert and thereby sacrificially breaking when the panel is impacted with a force in excess of a predetermined force.

13. A door which is selectively moved up and down to open and close an opening and which is guided along door guides at the edge of the opening, comprising:

a first chain disposed along one of the door guides and a second chain disposed along an opposed door guide;

a plurality of panels, each panel having a first end and a second end, the panels being arranged so as to align the top side of one panel with the bottom side of another panel, and each panel being of sufficient length to extend substantially across the opening but sufficiently limited in length so as to fit between the first and second chains such that there is no overlap of either the first or second end of the panels with any portion of the first and second chains;

a plurality of distinct connectors for joining the first and second chains respectively to the first and second ends of each of the panels; and, a pair of chains defined by interlinked hinges, the chains being disposed between the panels and the door guides of the door, the hinges being attached to the panels and carrying the panels for movement up and down, each interlinked hinge being pivotal about a hinge pin, each hinge having first and second ends, the first end having an extending male portion with a through-hole for receiving the hinge pin, the second end having a pair of spaced extending portions defining a female portion each extending portion having a through-hole for receiving the hinge pin, the through-holes of both the male and female hinge portions being aligned such that they are centered between planes defined by the front and back sides of the panels.

14. The door of claim 13 further including a roller and door guide assembly for guiding the chains wherein at least some of the hinge pins extend into the door guide, each extended hinge pin having rollers being rotationally engaged proximate the extended ends of the hinge pins, the rollers engaging a guide track thereby carrying the panels between an open and a closed position.

15. The door of claim 13 further including a motor operatively connected to the door to move the door along the door guide to open and close the door, wherein the door guide includes a first portion which guides the door vertically, a second portion which guides the door horizontally, and a third portion which directs the door into a coiled position for storage when the door is in an open position, the motor being situated so that a space between the first and third door guide portion is provided, the motor being located in the space between the first and third door guide portions, and the space being of sufficient size such that the door does not obstruct access to the motor from at least one direction when the door is accumulated into the overhead position.

16. The door of claims 13 wherein the hinges are structurally biased to rotate in a first direction from a straight in-line position when the door is closed to an angled position when the door panels are being accumulated overhead, but biased to resist rotation from a straight in-line position in a second direction opposite the first direction.

17. The door of claim 16 wherein the structural bias is provided by terminating the male and female extending portions with a rounded shoulder toward a side to which rotation is desired and a squared shoulder toward the opposed side where rotation is not desired.

18. The door of claim 13 further including a connecting assembly for securing each panel to a separate hinge at a first end and a second end of each panel, each panel generally abutting the two respective hinges with which it is associated having receptacles formed in at least one side of each hinge and a receptacle in the first end and second ends of each panel.

19. The door of claim 18 wherein the connecting assembly of at least the bottom-most panel to its respective two hinges permits separation of the panel from the hinges bodies upon an impact to the panel in excess of a predetermined force, without damage to either the hinges or the guide assembly.

20. The door of claim 19 wherein the connecting assembly between at least the bottom-most panel and its two respective hinges is sacrificially broken when the panel is impacted with a force in excess of a predetermined force.

21. The door of claim 19 wherein the connecting assembly includes a connecting insert having a first end, a second end and a center portion, the first end being secured in the receptacle of the hinge and the second end being secured in the receptacle in the end of the panel.

22. The door of claim 21 wherein the center portion of the connecting insert between at least the bottom-most panel and its two respective hinges is structurally weaker than the remaining portions of the connecting insert and thereby sacrificially breaking when the panel is impacted with a force in excess of a predetermined force.

23. A door which is selectively moved up and down to open and close an opening and which is guided at the edges of the opening and accumulated overhead when in an open position, comprising:

a door body having a plurality of panels hingedly connected together;

a door guide having a first portion which guides the door body vertically, a second portion which guides the door body horizontally, and a third portion which directs the door body into a coiled position for storage when the door is in an overhead position;

a motor operatively connected to the door to move the door body along the door guide to open and close the door, and being situated so that a space between the first and third door guide portion is provided, the motor being located in the space between the first and third door guide portions, and the space being of sufficient size such that the door body does not obstruct access to the motor from at least one direction when the door body is accumulated into an overhead position.

24. The door of claim 23 further including a first chain disposed along one of the door guides and a second chain disposed along an opposed door guide, the chains each comprising interconnecting hinges;

a plurality of panels, each having a first end and a second end, the panels being of sufficient length to extend substantially across the opening but sufficiently limited in length so as to fit between the first and second chains and so that there is no overlap of either the first or second end of the panels with any portion of the first and second chains; and, a plurality of connector for joining the first and second chains respectively to the first and second ends of each of the panels.

25. The door of claim 23 wherein the hinges are structurally biased to rotate in a first direction from a straight in-line position when the door is closed to an angled position when the door panels are being accumulated overhead, but biased to resist rotation from a straight in-line position in a second direction opposite the first direction.

26. The door of claim 25 wherein the structural bias is provided by terminating a male extending portion and a female extending portion with a rounded shoulder toward a side to which rotation is desired and a squared shoulder toward the opposed side where rotation is not desired.

27. The door of claim 23 wherein a connector joins each of the first and second ends of each panel generally in abutting relationship with a respective hinge in the first and second chain.

28. The door of claim 23 wherein each panel has a thickness equal to a thickness of the corresponding hinge that carries the panel.

29. The door of claim 23 wherein the connector for joining at least the bottom-most panel to its respective two hinges permits separation of the panel from the hinges upon an impact to the panel in excess of a predetermined force.

30. The door of claim 29 further comprising:

a panel receptacle in each end of at least the bottom-most panel;

a hinge receptacle in at least one side of each hinge to which the panel is joined at its ends; and, the connectors for joining at least the bottom-most panel to the chains has a first end, a second end and a center portion, the first end being secured in the hinge receptacle and the second end being secured in the panel receptacle.

31. The door of claim 30 wherein, at least one of the connectors for at least the bottom-most panel is sacrificially bent when the panel is impacted with a force in excess of a predetermined force and one of either the first or second ends of the connector withdraws from the panel or the hinge.

32. The door of claim 30 wherein, the connectors for at least the bottom-most panel are sacrificially broken when the panel is impacted with a force in excess of a predetermined force.

33. The door of claim 30 wherein the center portion of the connecting insert between at least the bottom-most panel and its two respective hinges is structurally weaker than the remaining portions of the connecting insert and thereby sacrificially breaking when the panel is impacted with a force in excess of a predetermined force.

* * * * *

UNITED STATES PATENT AND TRADEMARK OFFICE

CERTIFICATE OF CORRECTION

PATENT NO. : 6,123,139
DATED : September 26, 2000
INVENTOR(S) : Walenty Kalempa and Joe M. Delgado It is certified that error appears in the above-identified patent and that said Letters Patent is hereby corrected as shown below:

Column 8,
Line 23, change "claims" to -- claim --
Lines 43/44, after "hinges" and before "upon" delete -- bodies --

Column 9,
Line 27, change "connector" to -- connectors --

Signed and Sealed this

Ninth Day of October, 2001

*Attest:*

Nicholas P. Godici

*Attesting Officer*

NICHOLAS P. GODICI
*Acting Director of the United States Patent and Trademark Office*